US007581599B2

(12) United States Patent
Andersson

(10) Patent No.: US 7,581,599 B2
(45) Date of Patent: Sep. 1, 2009

(54) PERCUSSIVE DEVICE FOR A ROCK DRILLING MACHINE, METHOD FOR ACHIEVING A RECIPROCATING PISTON MOVEMENT AND ROCK DRILLING MACHINE

(75) Inventor: Kurt Andersson, Tyresö (SE)

(73) Assignee: Atlas Copco Rock Drills AB, Orebro (SE)

( * ) Notice: Subject to any disclaimer, the term of this patent is extended or adjusted under 35 U.S.C. 154(b) by 107 days.

(21) Appl. No.: 11/920,786

(22) PCT Filed: Jun. 14, 2006

(86) PCT No.: PCT/SE2006/000706

§ 371 (c)(1),
(2), (4) Date: Nov. 20, 2007

(87) PCT Pub. No.: WO2006/137775

PCT Pub. Date: Dec. 28, 2006

(65) Prior Publication Data

US 2009/0095498 A1 Apr. 16, 2009

(30) Foreign Application Priority Data

Jun. 22, 2005 (SE) ..... 0501448

(51) Int. Cl.
*B25D 9/00* (2006.01)
*E21B 1/26* (2006.01)

(52) U.S. Cl. ..... 173/91; 173/90; 173/206; 173/114; 173/200; 175/19; 175/296

(58) Field of Classification Search ..... 173/91, 173/200, 90, 206, 114; 175/19, 296
See application file for complete search history.

(56) References Cited

U.S. PATENT DOCUMENTS 3,741,316 A * 6/1973 Alajouanine ..... 173/107
3,774,502 A * 11/1973 Arndt ..... 91/246
3,805,896 A * 4/1974 Bauer ..... 173/16
4,308,926 A * 1/1982 Montabert ..... 173/162.1

(Continued)

FOREIGN PATENT DOCUMENTS

DE 10237407 4/2004

(Continued)

*Primary Examiner*—Brian D Nash
(74) *Attorney, Agent, or Firm*—Mark P. Stone

(57) ABSTRACT

A percussion device (1) with a reciprocating percussion piston (3), includes a first chamber (5) that can be pressurized for forward driving of the percussion piston (3) and a second chamber (8) that can be periodically pressurized for back-driving of the percussion piston (3). The percussion device includes at least one driving piston (7) arranged for actuating the back-driving of the percussion piston (3) wherein a portion of said driving piston (7) is arranged to enter into the second chamber (8) for pressure actuating on a driving surface of the driving piston by pressure medium being present in this chamber in the direction of back-driving, wherein the driving piston (7) includes means for back-driving co-operation with the percussion piston (3), and wherein the driving piston (7) is free for axial movement with respect to the percussion piston (3), opposite the direction of back-driving. The invention also concerns a method and a rock drilling machine.

24 Claims, 2 Drawing Sheets

U.S. PATENT DOCUMENTS

| | | | | | |
|---|---|---|---|---|---|
| 4,494,614 | A | * | 1/1985 | Eklof | 173/200 |
| 4,699,223 | A | * | 10/1987 | Noren | 175/40 |
| 4,718,500 | A | * | 1/1988 | Mori | 173/132 |
| 5,022,309 | A | * | 6/1991 | Campbell | 91/285 |
| 5,210,918 | A | * | 5/1993 | Wozniak et al. | 29/254 |
| 5,320,189 | A | * | 6/1994 | Rodert et al. | 175/296 |
| 5,372,196 | A | | 12/1994 | Andersson | |
| 5,653,295 | A | * | 8/1997 | Juvonen et al. | 173/208 |
| 5,794,717 | A | * | 8/1998 | Briggs et al. | 173/206 |
| 6,371,222 | B1 | * | 4/2002 | Andersson et al. | 175/135 |
| 6,523,622 | B1 | * | 2/2003 | Berger et al. | 173/212 |
| 6,609,577 | B2 | * | 8/2003 | Beccu | 173/93.6 |
| 6,854,538 | B2 | * | 2/2005 | Muuttonen | 175/414 |
| 6,877,569 | B2 | * | 4/2005 | Koskimaki | 173/1 |
| 7,484,570 | B2 | * | 2/2009 | Andersson et al. | 173/207 |
| 2003/0062176 | A1 | * | 4/2003 | Beccu | 173/93.6 |
| 2004/0144551 | A1 | * | 7/2004 | Koskimaki | 173/1 |
| 2006/0169468 | A1 | * | 8/2006 | Koskimaki et al. | 173/1 |
| 2007/0267223 | A1 | * | 11/2007 | Andersson et al. | 175/296 |
| 2007/0277991 | A1 | * | 12/2007 | Andersson et al. | 173/207 |

FOREIGN PATENT DOCUMENTS

| | | |
|---|---|---|
| EP | 0739691 | 10/1996 |

* cited by examiner

PERCUSSIVE DEVICE FOR A ROCK DRILLING MACHINE, METHOD FOR ACHIEVING A RECIPROCATING PISTON MOVEMENT AND ROCK DRILLING MACHINE

FIELD OF THE INVENTION

The invention concerns a percussion device for a rock drilling machine according to the preamble of claim 1 and a method for achieving a reciprocating percussion piston movement according to the preamble of claim 10. The invention also concerns a rock drilling machine including such a percussion device.

BACKGROUND OF THE INVENTION

From U.S. Pat. No. 5,372,196 is previously known a percussion device of this kind. This percussion device includes a percussion piston, which is reciprocatingly movable inside a machine housing. The reciprocating movement of the percussion piston is controlled by a valve device, wherein the valve element is movable to and fro in the machine housing. At its rear end, the machine housing has a space which is supplied with pressure fluid and thus drives the percussion piston in the forward direction. A second chamber that can be pressurized is arranged for back-driving the percussion piston.

The known percussion device functions well and aims to obtain percussive frequencies in the magnitude of 150 Hz. Recently raised desires of higher work rate and better economy in rock drilling have, however, resulted in the desire for yet higher percussive frequencies.

Aim and Most Important Features of the Invention

At the background of the above mentioned desires it is an aim of the present invention to provide a development of a percussion device as initially defined that gives the possibility of operation at higher frequency.

This aim is obtained in a percussion device of the kind stated initially through the features of the preamble of claim 1.

The corresponding is obtained in a method of the kind mentioned above through the features of the characterising portion of claim 10.

By providing a driving piston, having a driving area for actuation by pressure fluid in the second chamber, that can be made as great as desired, and in particular greater than a corresponding actuating surface on the percussion piston itself, the possibility is provided for increased back-driving speed and thereby increased percussion frequency.

Further, by the driving piston being separate, which in this connection means free for axial movement with respect of the percussion piston after that the percussion piston has performed its impact on a drill shank, it is avoided that an unfavourably shaped stress wave is produced in the drilling steel. In particular it is avoided that a stress wave peak is formed, which could be operationally unfavourable since it would bring along undesired strain peaks in the drilling steel. The percussion piston can therefore according to the invention be constructed optimally for performing the impact itself, whereas the back-driving aspects are considered when constructing the driving piston.

A further advantage is that the pressure in the second chamber can be chosen lower and that the percussion device still can have an essentially higher percussive frequency than a percussion device according to the background art.

With an arrangement according to the invention it is fully realistic to reach percussive frequencies of 300-500 Hz. Also other, particularly higher, percussive frequencies can, however, exist.

It is preferred that the driving piston includes a cushioning portion for co-operation with a cushioning chamber in the housing after performed impact of the percussion piston in order to obtain gentle cushioning of the driving piston after that the driving piston has ceased its co-operation with the percussion piston. In particular it is preferred that said cushioning chamber is connected to a pressure medium source for regaining energy emitted during cushioning by the increased pressure in the cushioning chamber being transmitted to said pressure medium source.

It is preferred that the first chamber is arranged to be pressurized to a permanent pressure. In particular the second chamber is periodically pressurized through the valve device. Through the arrangement with the driving piston, the relation between the driving area, pressure in the second chamber and pressure in the first chamber, can be chosen optimally in order to obtain a desired percussive frequency.

Corresponding advantages are obtained in a method and a rock drilling machine according to the invention.

BRIEF DESCRIPTION OF DRAWINGS

The invention will now be described in more detail by way of embodiments and with reference to the annexed drawings, wherein.

DESCRIPTION OF EMBODIMENTS

Figure 1:
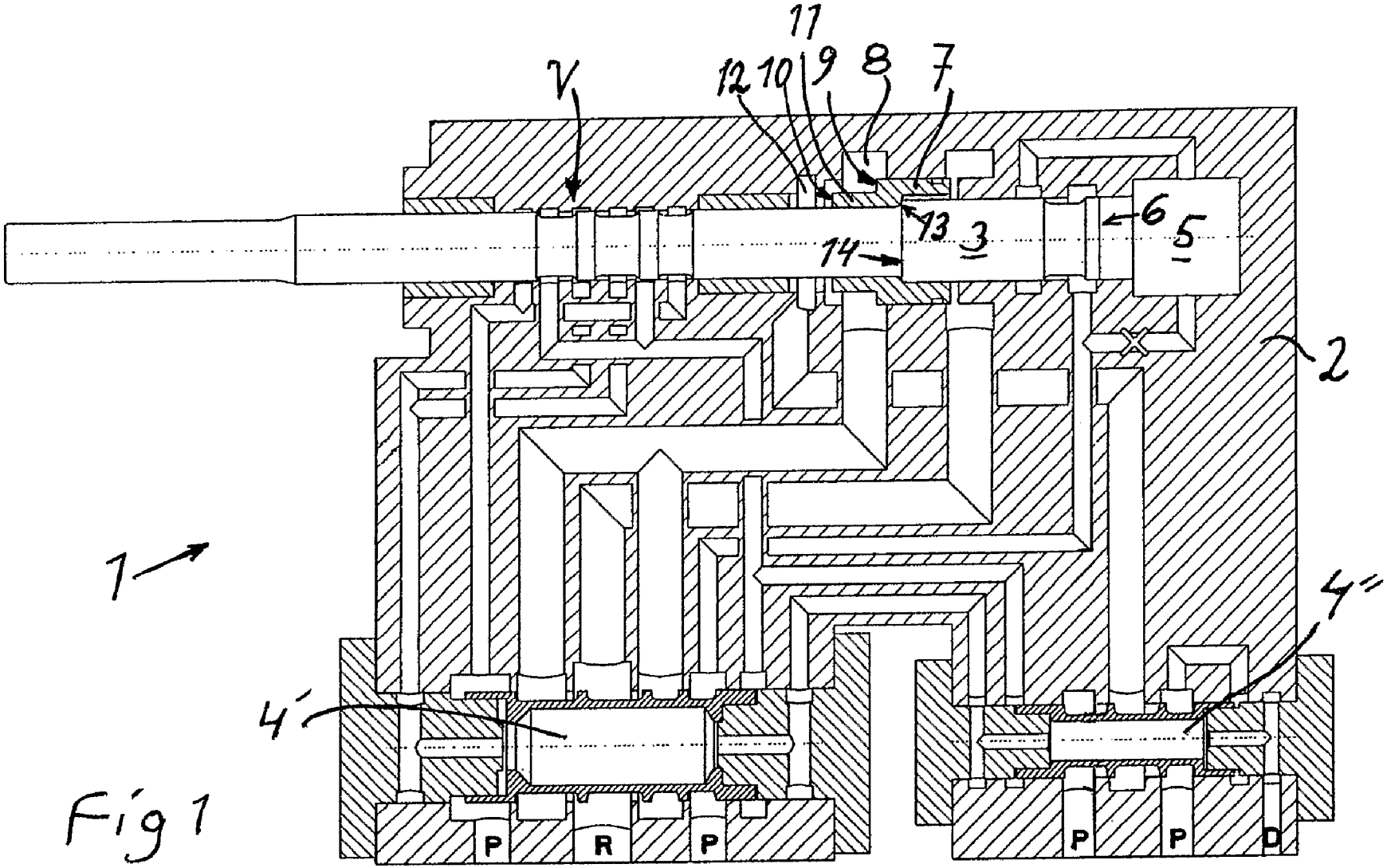
FIG. 1 diagrammatically shows a percussion device according to the invention with the percussion piston in a first position.

A percussion piston 1 shown in FIG. 1 includes, inside a housing 2, a reciprocatingly movable percussion piston 3 which with a rear pressure surface 6 is actuated by the pressure of pressurized fluid in a first chamber 5 in a forward direction of the percussion piston 3 for acceleration before performing an impact against a tool (not shown).

At a distance from the first chamber, the percussion piston 3 is surrounded by a driving piston 7, which with a driving surface including a first driving area 9 and a second driving area 10 is actuated by the pressure of a pressurized fluid in a second chamber 8 for back-driving the percussion piston 3 after a performed impact. For that purpose, the driving piston 7 has a ring-shaped engagement surface 13, which in a back-driving position co-operates with an actuating surface 14 on the percussion piston 3 for displacing the percussion piston 3 in backward direction, to the right as seen in FIG. 1.

Further, the driving piston 7 includes a cushioning portion 11, which in an advanced position of the driving piston 7 enters a cushioning chamber 12 in such a way that fluid that is enclosed inside this cushioning chamber 2 exerts a cushioning force on the second driving area 10 of the driving piston 7.

The first chamber 5 can be permanently pressurized, whereas the second chamber 8 can be periodically pressurized over the main valve 4' of the percussion device 1 in such a way that is per se previously known, whereby the valve element of the main valve 4' is controlled by the position of the percussion piston 3, which over a valve portion V on the percussion piston controls the valve element of the main valve 4' for pressurising and evacuating, respectively, of the second chamber 8.

Figure 2:
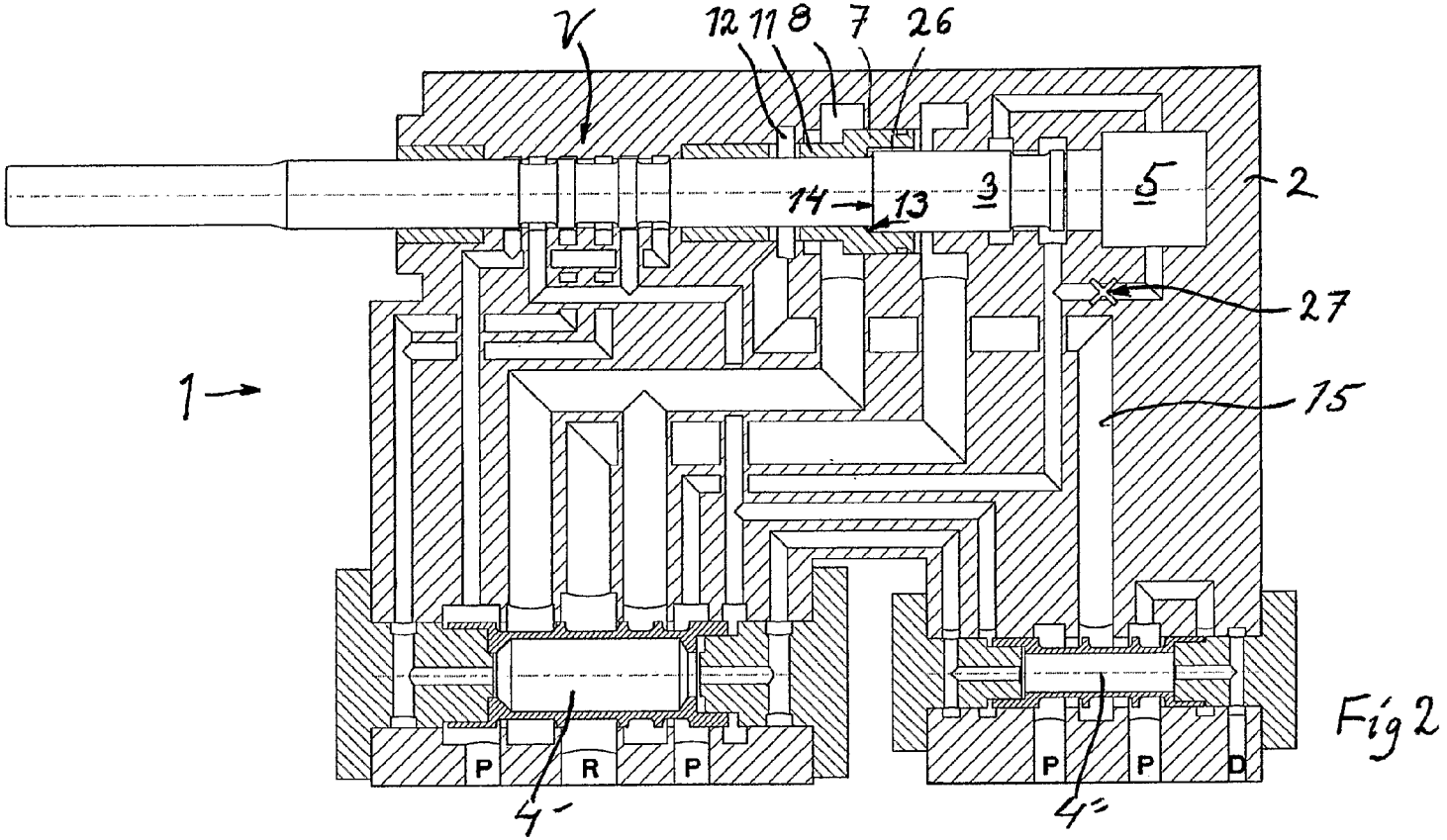
FIG. 2 shows the percussion device in FIG. 1 with the percussion piston in a second position, and FIG. 3 diagrammatically illustrates a method according to the invention by means of a block diagram.

FIG. 2 shows the percussion device 1 with the percussion piston 3 in a second position immediately after having performed an impact against a tool (not shown). In the position shown in FIG. 2, the driving piston 7 has been displaced so far in the percussion direction that its engagement surface 13 has left the contact with the actuating surface 14 of the percussion piston 3. The driving piston 7 has thus no axial contact with the percussion piston 3 in this position. With its cushioning portion 11 the driving piston 7 now enters the cushioning chamber 12, whereby its kinetic energy is being regained by the increased pressure of fluid being present in the cushioning chamber 2 being supplied to a pressure source over a regain channel 15 and auxiliary valve 4".

By the shown arrangement with a separate driving piston 7 which is free from the percussion piston 3 in connection with the latter performing its percussion movement, a disadvantageous stress wave configuration is avoided which otherwise would occur with a correspondingly added form to a percussion piston.

Figure 3:
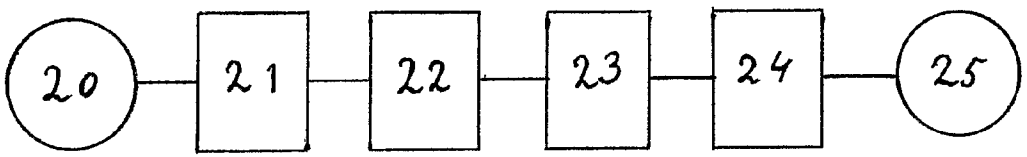

The method according to the invention for achieving a reciprocating percussion piston movement is diagrammatically illustrated in FIG. 3 as a block sequence.

Position 20 indicates the start of the sequence.

Position 21 indicates pressurising the first chamber 5 for the forward driving of percussion piston 3. This can be performed by essentially direct connection to a system pressure. (Mode 1).

Position 22 indicates evacuating pressure fluid in the second chamber 8 and thereby initiating a percussion movement of the percussion piston 3.

Position 23 indicated performing the percussion movement. The driving piston 7 now follows the percussion piston 3 in the forward direction until the impact has been completed. Thereafter the driving piston 7 moves axially freely with respect of the percussion piston 3 in the percussion direction.

Position 24 indicates the entering of the driving piston 7 with a cushioning portion 11 into a cushioning chamber 12 for cushioning its axial movement and possibly also for regaining the kinetic energy of the driving piston 7.

Position 25 indicates the stop of the sequence.

In a modified sequence it is provided that a connection to the first chamber can be blocked. This way is ensured a considerable pressure increase in the first chamber during the back-driving of the percussion piston. This pressure increase is as an example in the magnitude 3 times the system pressure. It is thus to be understood that other increase rates can exist.

The invention can be modified within the scope of the following claims. The driving piston as well as the percussion piston can be constructed otherwise with differently formed mutual means for achieving back-driving connection. In a modified driving piston, a specific thinned cushioning portion is missing. The driving piston can thus have unchanged section along its axial extension. It is also possible to have the driving piston constructed otherwise than as a sleeve. It can also be possible to have a plurality of driving pistons with suitable design distributed around the percussion piston.

The invention makes it possible to provide percussion devices with slender percussion pistons that are well shaped for their impact operation and still have powerful means for effective and fast back-driving of the percussion piston, whereby the aim of higher percussive frequency can be reached with relatively simple and cost efficient measures.

It is not necessary for the invention that the kinetic energy of the driving piston is regained in the manner that is described above even if this is preferred, i.a. because it contributes to better operating economy.

The energy loss occurring because the mass of the driving piston is not contributing to the impact energy at impact, can because of this aspect be regained by supplying the increased pressure in the cushioning chamber directly to the pressure system. More specifically it is regained through an accumulator (not shown in the figures) which is connected to the pressure system. The valve 4' I FIGS. 1 and 2 receives in the shown embodiment a signal from the valve V to open in order to free the connection between the cushioning chamber 12 and the system.

Other arrangements for obtaining the movement of the driving piston can also come into question. The valve arrangement for controlling the reciprocating movement can be constructed otherwise, for example by initiating a valve movement in any other way than through a valve portion V on the percussion piston.

The invention claimed is:

1. Percussion device (1) for a rock drilling machine including a housing (2) with a reciprocating percussion piston (3), the movement of which being controlled by a valve device (V, 4', 4"), wherein the housing includes a first chamber (5) that can be pressurized for forward driving of the percussion piston (3) and a second chamber (8) that can be periodically pressurized for back-driving of the percussion piston (3), characterised in that at least one driving piston (7) arranged for actuating the back-driving of the percussion piston (3) is arranged by the percussion piston (3), that a portion of said driving piston (7) is arranged to enter into the second chamber (8) for pressure actuating on a driving surface of the driving piston by pressure medium being present in this chamber in the direction of back-driving, that said driving piston (7) includes an engagement surface (13) for back-driving co-operation with an actuating surface (14) on the percussion piston (3), and that said driving piston (7) is free for axial movement with respect to the percussion piston (3), opposite the direction of back-driving, from a position of engagement between the engagement surface (13) and the actuating surface (14).

2. Percussion device according to claim 1, characterised in that the driving piston (7) is sleeve-shaped and arranged co-axially with and on the outside of the percussion piston (3).

3. Percussion device according to claim 2, characterised in that the driving piston (7) has a diameter which exceeds the diameter of the percussion piston (3).

4. Percussion device according to claim 2, characterised in that said driving piston (7) includes a cushioning portion (11) for co-operation with a cushioning chamber (12) in the housing after a performed impact by the percussion piston (3).

5. Percussion device according to claim 1, characterised in that said driving piston (7) includes a cushioning portion (11) for co-operation with a cushioning chamber (12) in the housing after a performed impact by the percussion piston (3).

6. Percussion device according to claim 5, characterised in that the cushioning chamber (12) is connected to a pressure medium source for regaining energy emitted during cushioning.

7. Percussion device according to claim 1, characterised in that said engagement surface (13) and actuating surface (14) include ring-shaped surfaces.

8. Percussion device according to claim 1, characterised in that the first chamber (5) is constructed to be pressurized to an essentially constant pressure.

9. Percussion device according to claim 1, characterised in that the first chamber (5) is arranged for obtaining a considerable pressure increase during the back-driving of the percussion piston.

10. Percussion device according to claim 1, characterised in that a pressure medium conduit is drawn to the first chamber (5) for maintaining a desired pressure.

11. Percussion device according to claim 1, characterised in that the second chamber (8) can be periodically pressurized through a valve device.

12. Percussion device according to claim 1, characterised in that the first chamber (5) is arranged to receive a rear end of the percussion piston (3), as seen in an impact direction against a tool.

13. Rock drilling machine including a percussion device according to claim 1.

14. Method for obtaining a reciprocating percussion piston movement, wherein a first chamber (5) is pressurized for forward driving of a percussion piston (3) and a second chamber (8) is periodically pressurized for back-driving of the percussion piston (3), characterized in that the percussion piston (3) is back-driven by means of at least one driving piston (7) which is arranged at the percussion piston (3), that pressure medium in the second chamber (8) is brought to pressure actuate the driving piston (7) in the back-driving direction, that the driving piston (7) during back-driving establishes a back-driving co-operation with the percussion piston (3), and that the driving piston (7) moves axially free with respect to the percussion piston (3), opposite to the direction of back-driving, from a position of said back-driving co-operation.

15. Method according to claim 14, characterised in that said driving piston (7) by means of a cushioning portion (11) co-operates with a cushioning chamber (12) in the housing after a performed impact by the percussion piston.

16. Method according to claim 15, characterised in that energy emitted during cushioning in the cushioning chamber (12) is regained in a pressure medium source.

17. Method according to claim 16, characterised in that the first chamber (5) is pressurized to an essentially constant pressure.

18. Method according to claim 16, characterised in that the first chamber (5) receives a considerable pressure increase during the back-driving of the percussion piston.

19. Method according to claim 15, characterised in that the first chamber (5) is pressurized to an essentially constant pressure.

20. Method according to claim 15, characterised in that the first chamber (5) receives a considerable pressure increase during the back-driving of the percussion piston.

21. Method according to claim 14, characterised in that the first chamber (5) is pressurized to an essentially constant pressure.

22. Method according to claim 14, characterised in that the first chamber (5) receives a considerable pressure increase during the back-driving of the percussion piston.

23. Method according to claim 14, characterised in that a rear end of the percussion piston (3), as seen in the percussion direction against the tool, protrudes into the first chamber (5).

24. Method according to claim 12, characterised in that a desired pressure is maintained in the first chamber (5) by supply from a pressure source.

* * * * *